US005108339A

United States Patent [19]

Kieves

[11] Patent Number: 5,108,339

[45] Date of Patent: Apr. 28, 1992

[54] NON-LATEX INFLATABLE TOY

[75] Inventor: Garry Kieves, Minneapolis, Minn.

[73] Assignee: Anagram International, Inc., Minneapolis, Minn.

[21] Appl. No.: 571,089

[22] Filed: Aug. 22, 1990

[51] Int. Cl.[5] ..... A63H 27/10

[52] U.S. Cl. ..... 446/221; 446/220; 446/224

[58] Field of Search ..... 446/69, 71, 220, 221, 446/222, 223, 224, 225, 226, 486

[56] References Cited

U.S. PATENT DOCUMENTS

| | | | |
|---|---|---|---|
| 2,540,403 | 2/1951 | Meyers | 446/221 |
| 2,635,387 | 4/1953 | Anderson | 446/221 |
| 2,675,770 | 1/1953 | Steew et al. | 446/221 |
| 4,077,588 | 3/1978 | Hurst | 244/31 |
| 4,674,532 | 6/1987 | Koyangi | 137/512.15 |
| 4,778,431 | 10/1988 | Dudley | 446/221 |
| 4,915,669 | 4/1990 | Russell | 446/221 |
| 4,917,646 | 4/1990 | Kieves | 446/224 |
| 4,966,568 | 10/1990 | Nakamura et al. | 446/221 |

FOREIGN PATENT DOCUMENTS

| | | | |
|---|---|---|---|
| 893680 | 4/1962 | United Kingdom | 446/221 |

*Primary Examiner*—Robert A. Hafer
*Assistant Examiner*—Sam Rimell
*Attorney, Agent, or Firm*—Allegretti & Witcoff, Ltd.

[57] ABSTRACT

A non-latex inflatable toy is disclosed which includes a first inner balloon encompassed by a partially transparent second outer balloon. An inflation unbilical extends from the stem of the outer balloon to the inner balloon, thereby defining various inflation paths. In one preferred embodiment, the balloons are inflated through two separate passageways in the outer balloon stem. In another, the outer balloon is inflated via the umbilical and the inner balloon.

12 Claims, 2 Drawing Sheets

NON-LATEX INFLATABLE TOY

BACKGROUND OF THE INVENTION

The present invention relates generally to non-latex balloons and more specifically to an inflatable toy including one balloon within a another balloon.

Brightly colored non-latex balloons have been popular for many years. These balloons are available in many different shapes and sizes.

Recently, a self-sealing valve has been introduced, allowing the balloon to be quickly and easily filled with helium. The valve is shown in U.S. Pat. No. 4,917,646 ("Kieves patent") and the teachings thereof are incorporated by reference herein. This valve eliminates the need for tying or heat-sealing of the balloon stem.

SUMMARY OF THE INVENTION

In a principal aspect, the present invention relates to an inflatable product including one balloon within another. Generally, the inner balloon is colorfully designed and the outer balloon is at least partially clear. The inner balloon is inflated through an inflation umbilical.

It is thus an object of the present invention to provide a novel and unique inflatable toy including a first inner balloon within the second outer balloon. Another object is an inflatable, floating toy including two self-sealing balloons in an encompassing relationship. Still another object is an inexpensive, readily manufactured and easily inflatable floating toy.

These and other features, objects and advantages of the present invention are described or implicit in the following detailed description.

BRIEF DESCRIPTION OF THE DRAWING

Preferred embodiments of the present invention are described herein with reference to the drawing wherein.

DETAILED DESCRIPTION OF A PREFERRED EMBODIMENT

Figure 1:
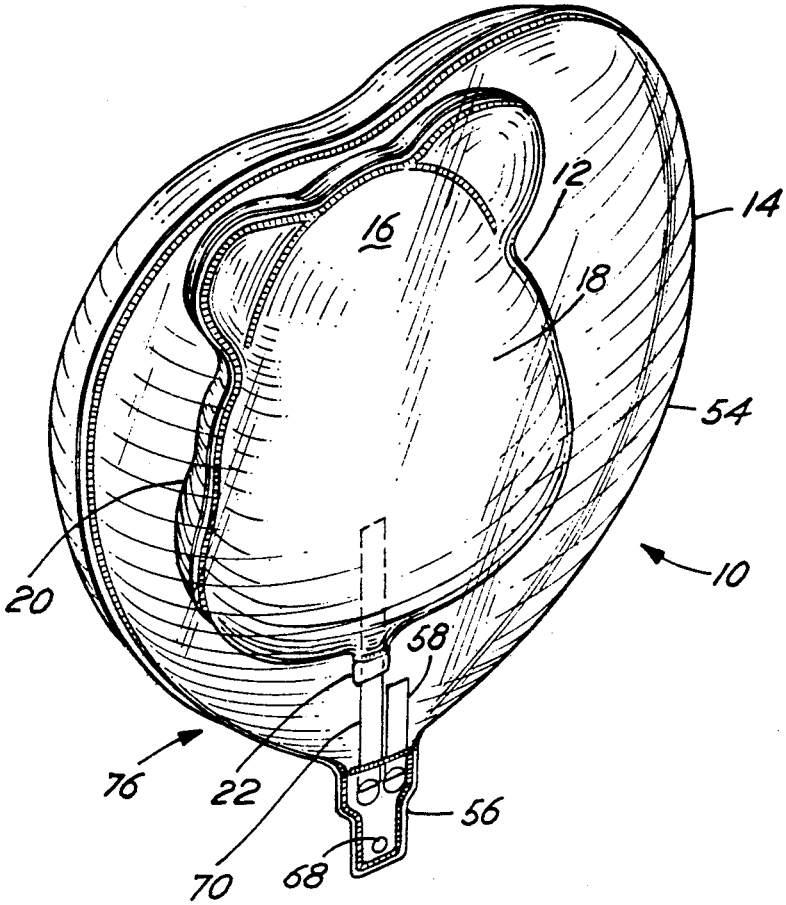
FIG. 1 is a perspective view of the floating toy, in an inflated state, illustrating the inner and outer balloons.

A preferred embodiment of the present invention is shown in FIGS. 1–4 as an inflatable toy, generally designated 10. Preferably the filling fluid is helium, such that the inflatable toy 10 will float.

The inflatable toy 10 includes two balloons 12, 14, respectively, in an encompassing relationship. More particularly, the first, inner and smaller balloon 12 fits within and is encompassed by the second, outer and larger balloon 14.

Preferably the first balloon 12 is a self-sealing, non-latex and metallized balloon defining a design 16, i.e., having a particular shape or having a design or character on at least one side 18 thereof. Although an animal configuration is depicted, the first balloon 12 could have any configuration (e.g., a circular shape).

Individually the first and second balloons 12, 14 are similar in nature to the self-sealing, non-latex balloon shown in the Kieves patent. The first balloon 12 includes first and second inner balloon sheets 12A, 12B, heat-sealed to define a body 20 and stem 22. An inner self-sealing valve 24, as described in the Kieves patent, is secured within the stem 22 and extends into the body 20 of the first balloon 12.

Preferably, the valve 24 includes first and second flexible plastic valve sheets 26, 28, sealed or fused along two longitudinal edge lines 30, 32. As shown, the second sheet 28 is longer than the first sheet 26 and defines a positioning tab 34 in an assembled state.

In the assembled valve state, the first and second valve sheets 26, 28 cooperate to define a valve inlet 36, valve outlet 38 and valve passageway 40 extending therebetween. The valve passageway 40 preferably includes an inlet section 42 extending from the valve inlet 36, an outlet section 44 extending from the valve outlet 36, and an interconnecting offset section 46. As shown, the outlet section 44 has a width corresponding to the width of the valve outlet 38, and the inlet section 42 has a greater width corresponding to that of the valve inlet 36. The offset section 46 provides a transition between the inlet and outlet sections 42, 44 and defines an offset angle in the range of fifteen (15) to forty (40) degrees.

The valve 24 also includes a bonding barrier 48 at the valve inlet 36, such that the inlet 36 is not sealed or closed during the balloon assembly process. In this preferred embodiment, the barrier 48 is a coating 50 of heat-resistant nitrocellulose ink, applied to the second sheet 28. The ink coating 50 extends across the width of the second sheet 28 between the two longitudinal edge lines 30, 32.

Figure 2:
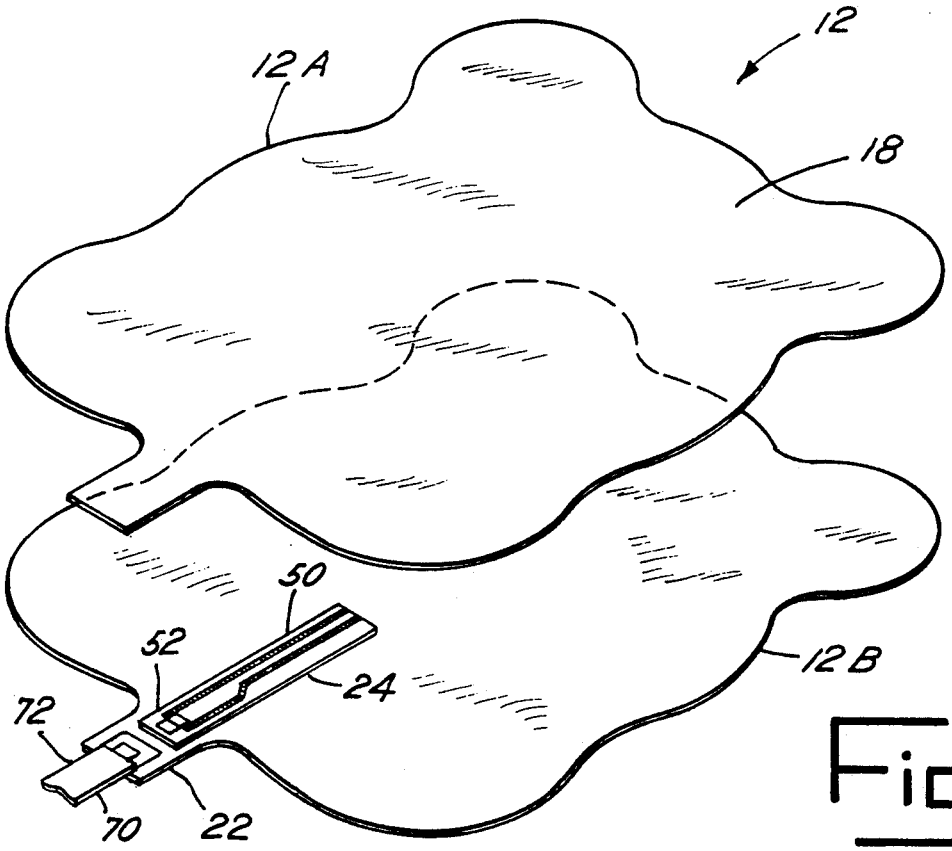
FIG. 2 is an exploded perspective view of the inner balloon of FIG. 1 shown in a deflated state, partially illustrating the inflation umbilical.

As best shown in FIG. 2, the valve 24 lies entirely within the first balloon 12. That is, a first portion 50 of the valve 24 extends into the body 20 and is substantially free or floating. This floating portion 50 facilitates sealing under pressure in that the floating portion 50 often partially folds over to crease the valve passageway 40.

A second portion 52 of the valve 24 extends into the stem 22. This second portion 52 includes the positioning tab 34 and valve inlet 36 and is preferably completely bonded to the balloon stem 22 in the final assembled balloon state. In this preferred embodiment, heat sealing integrally fuses the second portion 52 of the valve 24 within the stem 22.

The second balloon 14 is preferably a non-latex, partially clear balloon, such that the design 16 of the encompassed first balloon 12 is fully visible as it floats within the second balloon 14. In this preferred embodiment, one balloon sheet 14A of the second balloon 14 is metallized to provide a background for the design 16, while the other sheet 14B is clear. The second balloon 14 also includes a body 54 and stem 56, and it is sealed by an outer self-sealing valve 58. In this preferred embodiment, the valves 24 and 58 are virtually identical.

With particular reference to FIG. 1, the stem 56 of the second balloon 12 is enlarged in width and heat-sealed about its periphery. The balloon sheet 14B is punched to provide two inflation apertures 60, 62 in the stem 56, thereby defining two separate stem passageways 64, 66. respectively. The stem 56 further includes an opening 68 for attachment of a string or weight (not shown). The self-sealing valve 58 is heat-sealed within the first stem passageway 64 and otherwise freely floats within the second balloon 14.

Figure 3:
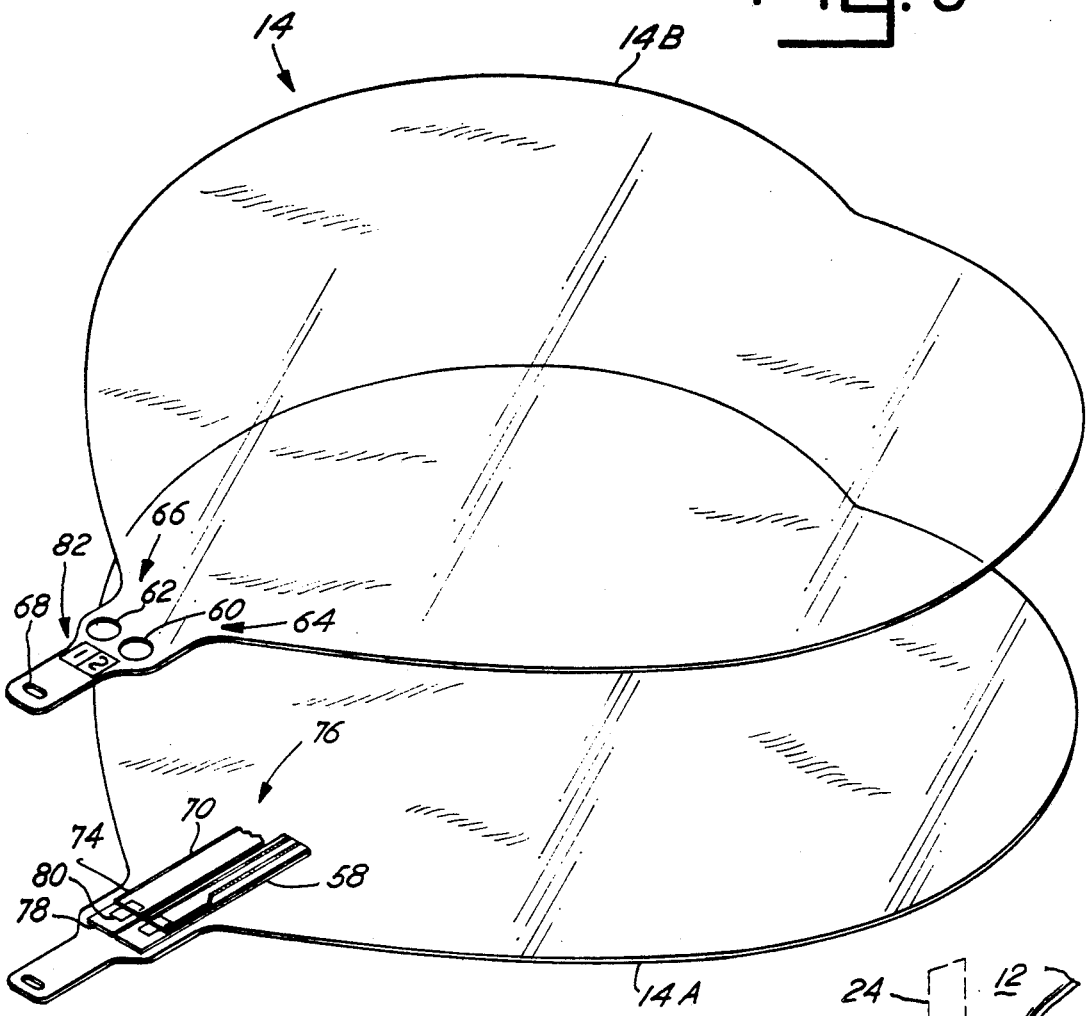
FIG. 3 is an exploded perspective view of the outer balloon of FIG. 1 shown in a deflated state, partially illustrating the inflation umbilical.

The inflatable toy 10 further includes an inflation umbilical 70, as shown in FIGS. 1 and 3. The umbilical 70 is a flexible plastic conduit and is preferably made from longitudinally heat-sealed strips of a low density polyethylene (e.g., as producible from the resin "ELVAX 3120" marketed by DuPont E I De Nemours & Co.).

The first and innermost end 72 of the umbilical 70 is heat-sealed within the stem 22 of the inner balloon 12. A second and outermost end 74 of the umbilical 70 is heat-sealed within the second stem passageway 66 of the outer balloon 14, as to provide an inflation link, generally designated 76, between the atmosphere and the inner balloon 12.

Both ends 72, 74 include an extension or tab 78 to facilitate placement and manufacture. A barrier 80 substantially avoids sealing during assembly.

The inner self-sealing valve 24 is in direct communication with the link 76. That is, any inflation fluid passing through the link 76 opens and flows through the valve 24.

The valve 24 could be incorporated anywhere along the inflation link 76. Similarly, a third valve (not shown) could be incorporated into the inflation link 76 near the second stem passageway 66.

The inflatable toy 10 further includes an indicia 82 on the outer balloon 14 or more particularly the stem 56 thereof. This indicia 82 designates the respective fluid communication paths and instructs the user to inflate the inner balloon 12 first. Inflation in the reverse order (i.e., outer balloon 14 first) may cause destruction of the outer balloon 14 as the inner balloon 12 is filled due to the inflexibility of the balloon material.

The inner balloon 12 is attached to the outer balloon 14 only by the umbilical 70. The inner balloon 12 is therefore freefloating and will, in the fully inflated state, move relative to the outer balloon 14.

Figure 5:
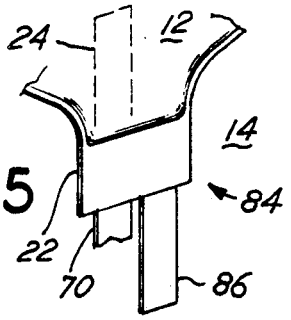
FIG. 5 is an enlarged, partial perspective view of an additional embodiment of the present invention wherein the outer balloon is inflated via the inner balloon.
Figure 4:
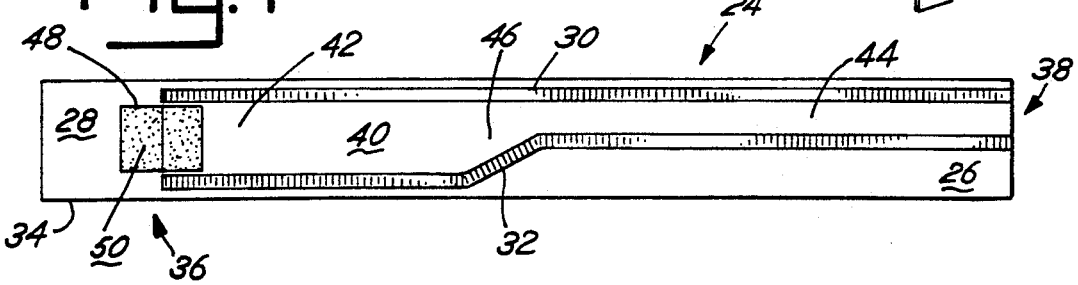
FIG. 4 is an enlarged top view of the self-sealing valve shown in FIGS. 2 and 3, which is described in detail in the Kieves patent.

Yet another embodiment of the present invention is shown in FIG. 5. The outer balloon 14 is filled via the umbilical 70 and a passageway 84 providing communication between the inner balloon 12 and the outer balloon 14. In this preferred embodiment, the passageway 84 is another self-sealing valve 86, like self-sealing valves 24 and 58, extending from the stem 22 of the inner balloon 12 into the outer balloon 14. As shown, the stem 12, as opposed to the stem 56, is enlarged to accommodate the umbilical 70 and the self-sealing valve 86.

The self-sealing valve 24 is, in this preferred embodiment, located within the inner balloon 12. The self-sealing valve 58 is eliminated, and only one inflation aperture 60 is provided. Alternatively, the stem 56 may be similar to that shown in the Kieves patent.

The self-sealing valve 86 is preferably designed to remain closed until a threshold inflation pressure is achieved within the inner balloon 12. One mechanism involves narrowing of the valve outlet 38 or the outlet section 44 of the self-sealing valve 86.

Preferred embodiments of the present invention have been described herein. It is to be understood that modifications and changes can be made without departing from the true scope and spirit of the present invention, which are defined by the following claims to be interpreted in view of the foregoing description.

What is claimed is:

1. An inflatable product comprising, in combination:

a first, inner and smaller non-latex balloon having a first body and a first stem and defining a design;

a second, outer and larger non-latex balloon having a second body and second stem, said second balloon having an encompassing relationship with respect to said first balloon, said second balloon being at least partially clear such that said design is visible therethrough, said second stem having first and second stem passageways;

an outer self-sealing valve partially secured within said first stem passageway and extending into said second body, said outer balloon being inflatable through said first stem passageway and said outer self-sealing valve;

an inflation umbilical interconnecting said first stem of said inner balloon and said second stem passageway of said outer balloon, said umbilical defining an inflation link for said inner balloon; and an inner self-sealing valve in communication with said inflation link, said inner balloon being inflatable through said inflation link and said inner self-sealing valve.

2. An inflatable product as claimed in claim 1 wherein said inner self-sealing valve is partially secured within said first stem and extends into said first body.

3. An inflatable toy as claimed in claim 2 wherein said outer balloon includes a first metallized plastic sheet and a second clear plastic sheet.

4. An inflatable toy as claimed in claim 1 further comprising an indicia upon said outer balloon indicating an inflation sequence.

5. An inflatable product comprising, in combination:

a first, inner and smaller non-latex balloon having a first body and a first stem and defining a design;

a second, outer and larger non-latex balloon having a second body, a first stem passageway and a second stem passageway, said second stem passageway being separate and distinct and lacking communication with said first stem passageway, said second balloon having an encompassing relationship with respect to said first balloon, said second balloon being at least partially clear such that said design is visible, said outer balloon being inflatable through said first stem passageway; and a flexible plastic umbilical interconnecting said first stem of said inner balloon and said second stem passageway of said outer balloon and defining an inflation link for said inner balloon, whereby said inner balloon is inflated through said second stem passageway of said outer balloon and said inflation link.

6. An inflatable product as claimed in claim 5 further comprising an inner self-sealing valve in communication with said inflation link.

7. An inflatable product as claimed in claim 6 wherein said inner self-sealing valve is partially secured within said first stem and extends into said first body.

8. An inflatable product as claimed in claim 6 further comprising an outer self-sealing valve in communication with said first stem passageway.

9. An inflatable product comprising, in combination:

a first, inner and smaller non-latex balloon, having a first stem and defining a design;

a second, outer and larger non-latex balloon, said second balloon having a second stem and an encompassing relationship with respect to said first balloon, said second balloon being at least partially clear such that said design is visible therethrough;

an inflation umbilical interposing said first and second stems and defining an inflation link to said inner balloon; and said first stem defining a passageway providing communication between said inner balloon and said outer balloon, whereby said outer balloon is inflated via said inflation link and said inner balloon.

10. An inflatable product as claimed in claim 9 further comprising a first self-sealing valve in communication with said inflation link.

11. An inflatable product as claimed in claim 9 further comprising a passageway providing communication between said inner balloon and said outer balloon, whereby said outer balloon is inflated via said inner balloon.

12. An inflatable product as claimed in claim 11 further comprising a second self-sealing valve extending from said inner balloon and in communication with said passageway.

* * * * *